US009380369B2

(12) United States Patent
Utterman et al.

(10) Patent No.: US 9,380,369 B2
(45) Date of Patent: Jun. 28, 2016

(54) MICROPHONE SEAL

(71) Applicant: Apple Inc., Cupertino, CA (US)

(72) Inventors: Erik Utterman, San Francisco, CA (US); Melody Kuna, Abilene, TX (US)

(73) Assignee: APPLE INC., Cupertino, CA (US)

( * ) Notice: Subject to any disclaimer, the term of this patent is extended or adjusted under 35 U.S.C. 154(b) by 437 days.

(21) Appl. No.: 13/767,503

(22) Filed: Feb. 14, 2013

(65) Prior Publication Data

US 2014/0226826 A1 Aug. 14, 2014

(51) Int. Cl.
*H04R 1/08* (2006.01)

(52) U.S. Cl.
CPC ..... *H04R 1/086* (2013.01); *H04R 2499/11* (2013.01)

(58) Field of Classification Search
None
See application file for complete search history.

(56) References Cited

U.S. PATENT DOCUMENTS

| | | | |
|---|---|---|---|
| 3,819,879 | A | 6/1974 | Baechtold |
| 4,336,861 | A | 6/1982 | Peter |
| 5,012,890 | A | 5/1991 | Nagi et al. |
| 5,092,424 | A | 3/1992 | Schreiber et al. |
| 5,210,793 | A | 5/1993 | Carlson et al. |
| 5,226,076 | A | 7/1993 | Baumhauer et al. |
| 5,260,681 | A | 11/1993 | Asai et al. |
| 5,261,006 | A | 11/1993 | Nieuwendijk et al. |
| 5,282,245 | A | 1/1994 | Anderson |
| 5,471,019 | A | 11/1995 | Maire |
| 5,479,520 | A | 12/1995 | Nieuwendijk et al. |
| 5,642,404 | A | 6/1997 | Hsu |
| 5,701,354 | A | 12/1997 | Komoda et al. |
| 5,790,679 | A | 8/1998 | Hawker et al. |
| 5,878,147 | A | 3/1999 | Killion et al. |
| 5,905,803 | A | 5/1999 | Dou et al. |
| 6,058,293 | A | 5/2000 | Phillips |
| 6,389,146 | B1 | 5/2002 | Croft, III |
| 6,473,625 | B1 | 10/2002 | Williams et al. |
| 6,614,911 | B1 | 9/2003 | Watson et al. |
| 6,681,023 | B1 | 1/2004 | Turnbull et al. |
| 6,728,386 | B1 | 4/2004 | Anderson |
| 6,758,303 | B2 | 7/2004 | Zurek et al. |
| 6,868,602 | B2 | 3/2005 | McCullough |
| 6,965,790 | B1 | 11/2005 | Mendolia |
| 7,031,455 | B2 | 4/2006 | Moquin et al. |
| 7,031,486 | B2 | 4/2006 | Hu |
| 7,069,061 | B2 | 6/2006 | Gammon et al. |
| 7,120,261 | B1 | 10/2006 | Turnbull et al. |
| 7,123,736 | B2 | 10/2006 | Eaton |

(Continued)

FOREIGN PATENT DOCUMENTS

| | | |
|---|---|---|
| EP | 0489551 | 6/1992 |
| JP | 2001211089 | 8/2001 |
| WO | WO02/34006 | 4/2002 |

*Primary Examiner* — Paul Huber
(74) *Attorney, Agent, or Firm* — Brownstein Hyatt Farber Schreck, LLP

(57) ABSTRACT

A microphone includes elements to protect against overpressure, such as from sudden physical shock. A cavity between ambient atmosphere and the microphone diaphragm includes a movable seal, which blocks overpressure from reaching the diaphragm when closed, and allows ordinary pressure to reach the diaphragm when open. The cavity can also have an entrance from ambient atmosphere offset from an exit to the diaphragm, and can include a valve which vents overpressure, or balloons in response to overpressure, so that overpressure does not directly reach the diaphragm. The seal or valve can be kept open or kept closed, and moved between states in response to whether the microphone should be in use or protected.

20 Claims, 3 Drawing Sheets

(56) References Cited

U.S. PATENT DOCUMENTS

| | | | | |
|---|---|---|---|---|
| 7,130,420 | B2 | 10/2006 | Windeballe et al. | |
| 7,239,899 | B2 | 7/2007 | Lin | |
| 7,260,364 | B2 | 8/2007 | Eaton | |
| 7,280,855 | B2 | 10/2007 | Hawker et al. | |
| 7,305,253 | B2 | 12/2007 | Snyder et al. | |
| 7,426,280 | B2 | 9/2008 | Aylward | |
| 7,627,343 | B2 | 12/2009 | Fadell et al. | |
| 8,103,029 | B2 | 1/2012 | Ngia et al. | |
| 8,126,138 | B2 | 2/2012 | Dinh et al. | |
| 8,170,256 | B2 | 5/2012 | Enstad et al. | |
| 8,224,012 | B2 | 7/2012 | Watson et al. | |
| 8,306,252 | B2 | 11/2012 | Dinh et al. | |
| 8,483,776 | B2 | 7/2013 | Murray | |
| 2002/0076041 | A1 | 6/2002 | Hietanen | |
| 2003/0179894 | A1* | 9/2003 | Saltykov | 381/313 |
| 2007/0237339 | A1 | 10/2007 | Konchitsky et al. | |
| 2008/0123891 | A1 | 5/2008 | Kato et al. | |
| 2008/0149417 | A1 | 6/2008 | Dinh et al. | |
| 2011/0110550 | A1* | 5/2011 | Bharatan et al. | 381/355 |
| 2011/0272769 | A1* | 11/2011 | Song et al. | 257/416 |
| 2012/0204650 | A1 | 8/2012 | Kleven | |
| 2013/0039508 | A1 | 2/2013 | Chen et al. | |
| 2013/0064390 | A1 | 3/2013 | Dinh et al. | |
| 2014/0093114 | A1 | 4/2014 | Nguyen et al. | |
| 2014/0133687 | A1* | 5/2014 | Lee | 381/355 |

* cited by examiner

MICROPHONE SEAL

TECHNICAL FIELD

This application generally relates to a microphone seal, and other matters.

BACKGROUND

It sometimes occurs that portable mobile devices are subject to sudden mechanical shock, such as when accidentally dropped, struck against obstacles, having a lid closed too rapidly, or otherwise. These shocks can have a substantial sonic or air pressure effect on relatively smaller cavities in the device, such as when sonic pressure is applied to an input port coupled to a microphone. For example, when portable mobile devices allow audio input, such as voice input from a user, a microphone (or a microphone assembly) included in the portable mobile device can include at least one such cavity. It sometimes occurs that the microphone (or a portion of the microphone, such as its diaphragm) can be subject to substantial damage by sonic pressure in the event of a sudden mechanical shock.

It also sometimes occurs that microphones in portable mobile devices can be subject to sudden atmospheric shock, such as when those devices are improperly handled at or near an input for the microphone. Similar to mechanical shocks described above, these can have a substantial sonic pressure effect on the microphone, with the possibility of subjecting the microphone (or a portion of the microphone, such as its diaphragm) to substantial damage. For example, when an electric discharge (such as an electrical spark) occurs at or near an input port coupled to the microphone (or a microphone assembly), sonic pressure might damage the microphone or its diaphragm.

Each of these examples, as well as other possible considerations, can cause one or more difficulties as a result of damage to the microphone of a portable mobile device. For a first example, the device can lose some of its intended function, such as that the user might become unable to use the voice input or other audio input features of the device. For a second example, the device can exhibit unexpected behavior, such as that the user might experience lesser tonal response or other audio response from the device than expected, or might experience increased noise effects from distortion or partial damage of the microphone. In contrast, the device can benefit from protecting against microphone damage.

SUMMARY OF THE DISCLOSURE

This application provides techniques, including devices and structures, and including method steps, that can protect a microphone (or other instruments sensitive to sonic pressure) from damage in the event of sudden shock. For example, sudden shock can include mechanical shock to the device, or other atmospheric shock occurring near the device. These techniques can be incorporated into one or more different devices that allow voice input or other audio input, or that otherwise respond to atmospheric effects. For example, these techniques can be incorporated into portable telephones or radiotelephonic devices, portable touch devices such as tablets or mini-tablets, portable computing devices such as laptops or netbooks, or other types of devices.

A microphone (or an assembly including a microphone) can include elements to protect against sonic pressure, such as from sudden physical shock or sudden atmospheric shock. For example, the microphone or assembly can include one or more elements to prevent the sonic pressure from reaching the microphone, such as mechanical elements that can be moved into a sonic pathway in the event of shock, and out of the sonic pathway when the microphone is intended to be in use. Alternatively, or in addition, a microphone (or an assembly including a microphone) can include elements to ameliorate one or more effects of sonic pressure. For example, the microphone or assembly can include one or more elements to vent the sonic pressure, such as one or more sonic pathways that can be opened in the event of shock, or closed when the microphone is intended to be in use.

In one embodiment, a cavity located between ambient atmosphere and the microphone diaphragm can include a movable seal, which can block sonic overpressure from reaching the diaphragm in a first state (such as when closed), and allows ordinary sound waves to reach the diaphragm in a second state (such as when open). For a first example, sonic overpressure can actuate the movable seal, such as by pushing the seal into place, which can alter the state of the movable seal to protect the microphone in the event of a sudden shock. For a second example, the shock itself can actuate the movable seal, such as by accelerating a portion of the seal or a weight attached thereto, which can alter the state of the movable seal, again, to protect the microphone in the event of a sudden shock.

In one embodiment, the movable seal can be actuated by an electromagnetic circuit, which can be responsive either to sonic overpressure or to a shock (such as in response to an accelerometer or another type of inertial response sensor). For a first example, the movable seal can be maintained in a first state (such as a closed state) or a second state (such as an open state) using a bimetallic strip, an electromagnetic strip, a memory-metal alloy, a solenoid, or another element having a mechanical response to an electrical or electromagnetic signal.

In such examples, the electrical or electromagnetic signal can be responsive either to sonic overpressure or to a shock, and the mechanical response can have the effect of altering the movable seal from the first state to the second state (or vice versa), to protect the microphone in the event of a sudden shock. In a first such case, a device can maintain the movable seal normally sealed, and can actuate the movable seal to become unsealed when the microphone is intended to be in use. In a second such case, the device can maintain the movable seal normally unsealed, and can actuate the movable seal to become sealed when a mechanical shock or sonic overpressure is detected.

In one embodiment, the cavity can include a partial seal having more than one stable state, such as a mesh have a relatively closed state (such as with a relatively tight mesh gap) and a relatively open state (such as with a relatively loose mesh gap). This can have the effect of providing a first state with relatively greater protection against sonic pressure, with the effect of protecting the microphone against damage, and a second state with relatively greater sensitivity to sound waves, with the effect of providing the microphone with sensitivity to acoustic signals.

In one embodiment, the cavity can include a bistable (or semi-stable) mechanical structure, such as a bistable dome, disposed for switching between a first stable state and a second stable state, such as mechanically, electrically or electromechanically, or otherwise. For example, a bistable dome can include a "popped-up" state in which the dome presents a bubble shape, and a "pushed-in" state in which the dome presents a dimpled shape, or other bistable or multi-stable, or semi-stable shapes. In a first such case, a bistable dome can be stable in both states, with one of the two states providing protection to the microphone against sonic pressure, and the other of the two states providing availability to the microphone of sound waves, such as from an acoustic signal. In a second such case, a semi-stable structure can be stable in one of two states, with one of the two states providing protection as described herein, and the other of the two states providing availability as described herein. Moreover, in such cases, the bistable or multi-stable, or semi-stable, structure can have its state altered using an electro-mechanical switch, a solenoid, or another type of device.

In one embodiment, the cavity can include an actuated opening or closing element that can enter a first state (such as an open position) or a second state (such as a closed position) with respect to a sonic pathway coupled to the microphone (or microphone assembly). For example, the actuated element can include a rotatable disk, having an opening that can be aligned or de-aligned with the sonic pathway. In such cases, the actuated element can be coupled to an actuator disposed outside the disk, such as an external motor or linear actuator.

In one embodiment, the cavity can include an expandable element having at least one stable state. At a relatively normal pressure the expandable element can allow the microphone to operate in a relatively normal manner, while at a relatively elevated pressure (such as might occur during a pressure overage) the expandable element can expand to absorb the increased pressure, to protect the microphone against the effect of sudden shock. For example, the expandable element can include a rubber gasket or other stretchable membrane, which can expand at a relatively elevated pressure to increase the volume of an enclosed portion of a microphone, with the effect of ameliorating the pressure on components of the microphone. In such examples, the expandable element can be disposed at a location so that atmospheric inflow from a sudden pressure change would be applied relatively directly to the expandable element, with the effect that the expandable element can relatively rapidly absorb the effect of the pressure change. In such examples, the expandable element can even be breakable, at least to the extent that breaking the expandable element would be superior to breaking the microphone.

In one embodiment, the cavity can include elements of a microphone disposed at an offset from a location where atmospheric inflow from a sudden pressure change would be applied. This can have the effect that an effect of a sudden pressure change would be mitigated, as the pressure change would tend to be distributed throughout the enclosed portion of the microphone, that is, would tend not to be directly applied to the elements of the microphone. This can have the effect that the elements of the microphone could be maintained away from the location where atmospheric inflow from a sudden pressure change would occur.

In one embodiment, the cavity can include compressible or soft elements, disposed to expand the cavity in the event of sonic overpressure, or even to de-link from the cavity in the event of sonic overpressure and to vent overpressure to ambient (or to another cavity). For a first example, the cavity can include a compressible foam, a contractible or expandable bellows, or another type of device or structure for venting sonic overpressure. For a second example, the cavity can include devices or structures responsive to a detector (such as an accelerometer or another type of inertial response detector) that operate to expand the cavity or to open the cavity in the event of relatively high acceleration.

In one embodiment, the microphone can be reinforced with one or more compressible or soft elements, disposed to absorb forces on the microphone in the event of sonic overpressure, or even to de-link the microphone from the cavity in the event of sonic overpressure. For a first example, the microphone (or a portion thereof such as its diaphragm) can be coupled to a compressible form, a contractible or expandable bellows, or another type of device or structure for absorbing sonic overpressure. For a second example, the microphone can include devices or structures responsive to a detector (such as an accelerometer or another type of inertial response detector) that operate to absorb sonic overpressure on the microphone or its diaphragm in the event of relatively high acceleration.

Although this application describes exemplary embodiments and variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. The drawings and detailed description are intended to be illustrative in nature and not restrictive.

DETAILED DESCRIPTION

Terms and Phrases

The text "actuator", and variants thereof, generally refers to any device or assembly capable of controlling another device. For example, an actuator can include a motor or switch capable of exerting a mechanical effect, or such as an electrical device capable of generating an electrical or electronic signal, coupled to that other device.

The text "microphone", and variants thereof, generally refers to any device or assembly capable of receiving sound waves, such as propagated through atmosphere or another gas, and in response thereto, generating an audio signal, such as an electrical signal representative of those sound waves.

The text "sonic pressure", and variants thereof, generally refers to any pressure effect resulting from sound waves. For example, sonic pressure can include pressure propagated through atmosphere or another gas. Thus, air pressure can be one example of a sonic pressure induced in a particular medium.

Microphone Assembly

Figure 1:
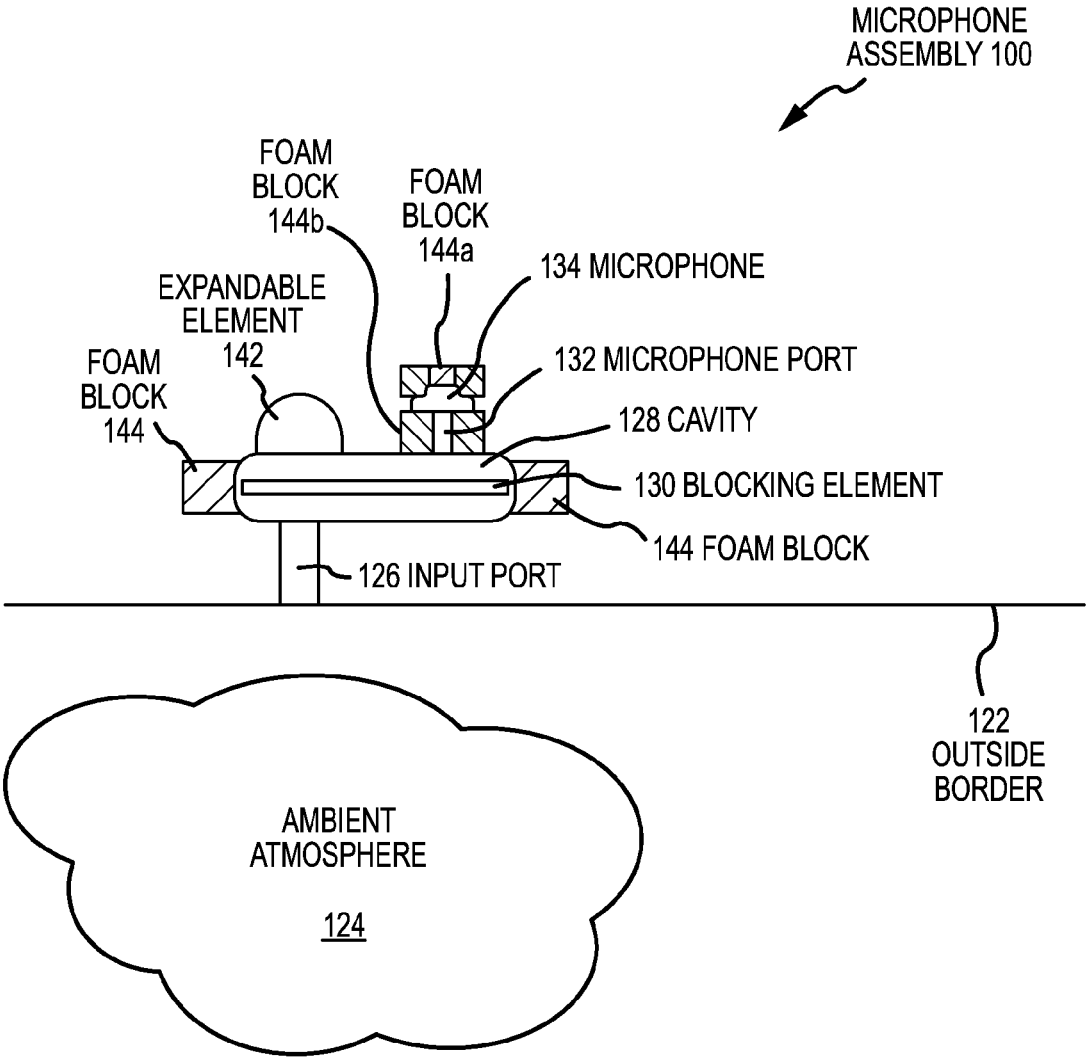
FIG. 1 shows a conceptual drawing of a microphone assembly.

FIG. 1 shows a first conceptual drawing of a microphone assembly.

A microphone assembly 100 can be disposed near to an outside border 122, such as an edge of a portable mobile device, or an edge of a subassembly, or other region from which external gas pressure might become applied. While this application primarily describes embodiments in which the outside border 122 is an outside edge of a portable mobile device, in the context of the invention, there is no particular requirement for any such limitation. For example, the outside border 122 could include an edge of a microphone subassembly disposed inside a portable mobile device, or otherwise.

The outside border 122 can be disposed near ambient atmosphere 124, and be coupled to an input port 126, such as including a pathway that allows sound waves to enter from the ambient atmosphere 124. The input port 126 can be coupled to a cavity 128, such as described in further detail herein, which can include a blocking element 130 that can either allow or prevent sound waves that enter the cavity 128 from continuing onward. The blocking element 130 can be coupled to one or more actuators or stabilizers (not shown), which can cause the blocking element 130 to maintain one of two or more states (such as "open" or "closed") and can cause the blocking element 130 to transition between or among those states.

The cavity 128 can be coupled (on another side from the blocking element 130) to a microphone port 132, such as including a pathway that allows sound waves to be coupled from the cavity 128 to a microphone 134. As described herein, when the blocking element 130 is disposed to prevent sound waves that enter the cavity 128 from continuing onward, there is substantially no acoustic coupling between the input port 126 and the microphone port 132. In contrast, when the blocking element 130 is disposed to allow sound waves that enter the cavity 128 from continuing onward, the cavity 128 allows substantially transparent acoustic coupling between the input port 126 and the microphone port 132.

Ameliorating Sonic Pressure

In one embodiment, the cavity 128 is disposed so that the input port 126 is located at an offset from the microphone port 132, with the effect that sonic pressure that enters the cavity 128 is not directed at the microphone port 132. Instead, sonic pressure that enters the cavity 128 is directed at one or more walls of the cavity 128, and does not direct its force against the microphone 134.

In one embodiment, the cavity 128 is disposed to include an expandable element 142, such as a balloon or a relatively weaker metal portion of a wall of the cavity 128. For example, the expandable element 142 can be located where sonic pressure entering the cavity 128 would be directed at the expandable element 142. This could have the effect of causing the expandable element 142 to expand, in response to the sonic pressure entering the cavity 128, thus reducing the effect of the sonic pressure on the microphone 134. As an alternative, a relatively thin diaphragm may be situated between the expandable element 142 and cavity, and the expandable element may be relatively or fully constant in volume. Sonic or air pressure may break the diaphragm to permit air or pressure to enter the expandable element, thereby venting at least some of the pressure and protecting the microphone 134.

In one embodiment, the cavity 128 is disposed to include one or more foam blocks 144, or other compressible or expandable elements. For example, the cavity 128 can include one or more bellows or other structures that are compressible or expandable, in addition to or in lieu of the foam blocks 144. This could have the effect of causing the compressible or expandable elements to increase the size of the cavity 128 in response to the sonic pressure entering the cavity 128, thus reducing the amount of that pressure, and thus reducing the effect of that pressure on the microphone 134.

In one embodiment, the microphone 134 has one or more foam blocks 144*a* and 144*b*, or other compressible or expandable elements, disposed to absorb excess sonic pressure that might be applied to the microphone 134. This could have the effect that energy from that excess sonic pressure would be dispersed, rather than applied directly to the parts of the microphone 134 (or the parts of a subassembly including the microphone 134), with the effect that the microphone 134 would be less subject to damage from excess sonic pressure.

For example, the foam block 144*a* can be disposed behind the microphone and capable of absorbing excess sonic pressure that might be applied to the microphone 134. In such cases, the foam block 144*a* could be overpowered by the sonic pressure and thus compressed, forcing the microphone 134 away from the cavity 128, removing the connection between the microphone port 132 and the cavity 128, and isolating the sonic pressure from the microphone 134. In such cases, the foam block 144*b* could be disposed in a ring shape about the microphone port 132, with the effect that the foam block 144*b* could expand while the foam block 144*a* could be compressed, again having the effect of removing the connection between the microphone port 132 and the cavity 128, and isolating the sonic pressure from the microphone 134.

It should be appreciated that not all of the foam blocks 144*a*, 144*b*, expandable element 142 and/or blocking elements 130 need be present in any given embodiment. Embodiments may have one, two or more of these items and the configuration and/or location of such items may vary. For example, the expandable element 142 may be positioned in a different part of the cavity 128, or even may connect to the input port 126 instead of the cavity. Thus, although FIG. 1 shows all of these elements, it should be appreciated that this is for the convenience of the reader and not intended as a requirement for any given embodiment.

Blocking Element

FIG. 2 (collectively including FIGS. 2A, 2B, 2C, 2D, and 2E) shows conceptual drawings of blocking elements, which may generally block sonic or air pressure from impacting the microphone or at least reduce such pressure. These various blocking elements are shown in cross-section and may be positioned approximately where the blocking element 130 is shown in FIG. 1. It should be appreciated that the blocking element may extend across an entirety of one or more dimensions of the cavity 128, so that it (at least in certain configurations) interrupts free flow from the input port to the microphone port. Likewise, the blocking element or elements may define passages other than those seen in FIGS. 2A-2E either within their bodies or in cooperation with a wall of the cavity 128, input port 126, and/or microphone port 132. As discussed below, a variety of the blocking elements may permit air flow and/or sonic pressure to pass through the element in certain configurations and block air flow and/or sonic pressure in other configurations.

In one embodiment, the blocking element 130 can be coupled to one or more walls of the cavity 128. This can have the effect that when the blocking element 130 is closed, sonic pressure cannot penetrate the blocking element 130, and cannot propagate from the input port 126 to the microphone port 124. This can have the effect that the blocking element 130 provides a function of blocking sonic pressure, as described herein.

In one embodiment, one or more of the described possible blocking elements 130 can be incorporated into apparatus that protects the microphone input port 124 and the microphone 126 from sonic pressure. For example, one or more of the described possible blocking elements 130 can be disposed in series, such as one after the other, with the effect of blocking sonic pressure by each such possible blocking element 130 in turn. In alternative embodiments, one or more of the described possible blocking elements 130 may be disposed in parallel, such as one next to the other, with the effect of blocking sonic pressure in the alternative by distinct blocking elements 130.

In one embodiment, one or more of the described possible blocking elements 130 can be can be opened or closed by an actuator (not shown).

For a first example, the actuator can be responsive to sonic pressure, with the effect that one or more of the described possible blocking elements 130 closes due to sonic pressure whenever that sonic pressure exceeds some selected amount.

For example, if normal sound waves exhibit air pressure with a maximum of about 2 PSI, the flexible structure can be disposed to close when sonic pressure exceeds 5 PSI. These particular values are only exemplary. Other values for normal sound waves or for a sound pressure selected for closing the flexible structure could be used.

For a second example, the actuator can be responsive to acceleration, with the effect that the flexible structure closes due to application of sufficient acceleration. For example, if the microphone 126, or the device including the microphone 126, is normally subject to acceleration with a maximum of about 2 g (gravities), the flexible structure can be disposed to close when acceleration exceeds 5 g. These particular values are only exemplary. Other values for normal acceleration or for an undesired acceleration selected for closing the flexible structure could be used.

Figure 2A:
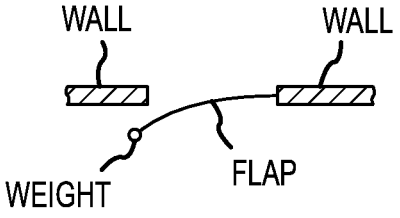
FIG. 2 (collectively including FIGS. 2A, 2B, 2C, 2D, and 2E) shows conceptual drawings of blocking elements.

FIG. 2A shows a conceptual drawing of a first type of blocking element.

In one embodiment, a blocking element 130 can include a flap or other flexible structure, the flexible structure being responsive to sonic pressure, with the effect that the flexible structure closes due to sonic pressure whenever that sonic pressure exceeds some selected amount.

In one embodiment, the blocking element 130 can include, either in addition or instead, a weight or other structure that is sensitive to acceleration, with the effect that the flexible structure closes due to application of sufficient acceleration.

Figure 2B:
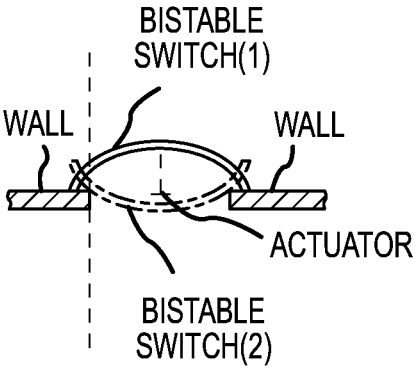

FIG. 2B shows a conceptual drawing of a second type of blocking element.

In one embodiment, the blocking element 130 can include a bistable, multi-stable, or semi-stable element, such as a pop-up button. In the figure, a pop-up button is shown as an example blocking element 130, the pop-up button having two stable states, "closed" (popped-up) and "open" (pushed-in), and an actuator that can alter the blocking element 130 from one state to another.

For a first example, the blocking element 130 can be maintained in a "closed" state by being set to popped-down (e.g., in the position shown in phantom in FIG. 2B), in which case the blocking element 130 blocks passage of sound pressure into or through the cavity 128. For a second example, the blocking element 130 can be maintained in an "open" state by being set to pushed-in, in which case the blocking element 130 allows free passage of sound waves into or through the cavity 128 (such as by allowing venting between the sides of the blocking element 130 and the walls of the cavity).

While this application shows the blocking element 130 as having two stable states, in the context of the invention, there is no particular requirement for any such limitation. For a first example, the blocking element 130 can have more than two stable states, such as a first state similar to the "closed" state described above, a second state similar to the "open" state described above, and a third state being partially open or partially closed. For a second example, the blocking element 130 may be semi-stable, or may have only one stable state. In such cases, the non-stable state may involve being actuated to be maintained. One such case might include a pop-up button that is stable when open, and which is actuated to be maintained in a closed state.

Figure 2C:
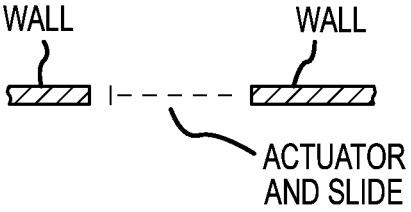

FIG. 2C shows a conceptual drawing of a third type of blocking element.

In one embodiment, the blocking element 130 can include a sliding element, such as a sliding door moved by an actuator. Similar to other possible blocking elements 130 described herein, this can have the effect that when the blocking element 130 is closed, sonic pressure cannot penetrate the blocking element 130, and cannot propagate from the input port 126 to the microphone port 124. This can have the effect that the blocking element 130 provides a function of blocking sonic pressure, as described herein.

Figure 2D:
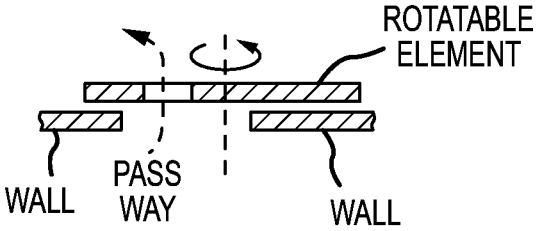

FIG. 2D shows a conceptual drawing of a fourth type of blocking element.

In one embodiment, the blocking element 130 can include a rotatable element, such as a rotatable disk. In the figure, a rotatable element is shown edge-on, so that an axis of turning the rotatable element is substantially parallel to the plane of the figure. The rotatable element can include a hole, with the effect that when the hole is substantially aligned with the input port 126, sound waves can enter or penetrate the cavity 128. This also has the effect that when the hole is substantially unaligned with the input port 126, sound pressure cannot enter or penetrate the cavity 128.

In one embodiment, the rotatable element can be moved by an actuator (not shown). For a first example, the actuator can be coupled to an edge of the rotatable element, and cause the rotatable element to rotate. For a second example, the actuator can be coupled to a surface of the disk of the rotatable element, and cause the rotatable element to rotate.

In one embodiment, the rotatable element can include a ratchet or similar structure, with the effect that when rotated, the rotatable element does not easily reverse rotation.

Figure 2E:
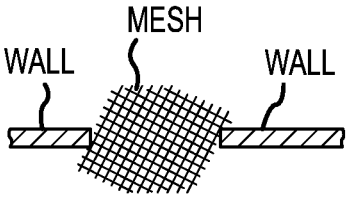

FIG. 2E shows a conceptual drawing of a fifth type of blocking element.

In one embodiment, the blocking element 130 can include a mesh, weave, or similar structure that presents one or more passages through the mesh, and which can be substantially tightened or loosened (such as by an actuator). This can have the effect that the mesh can block sound pressure when maintained in a relatively tighter mesh form, and can allow passage of sound waves when maintained in a relatively looser mesh form. The mesh may have a thickness equal to that of the side walls to which the mesh is affixed or otherwise attached. Alternatively, the mesh may be thinner than the thickness of the side walls or greater than the thickness of the side walls. Likewise, it should be appreciated that the mesh may define a passage upward or downward with respect to the orientation shown in FIG. 2E, or inward or outward with respect to that orientation.

In one embodiment, the mesh, weave, or similar structure associated with the blocking element 130 can be tightened or loosened by an actuator (not shown). For a first example, the actuator can be activated by a measurement of sound pressure, such as a measurement of sound pressure that indicates an amount of sound pressure greater than ordinary sound waves, as described above. For a second example, the actuator can be activated by a measurement of acceleration, such as a measurement of acceleration that indicates an amount of acceleration greater than ordinary usage, as described above. The sensed input may cause the actuator to mechanically tighten or loosen the weave of the mesh, depending on the input. For example, a measurement of increased sound pressure, velocity or acceleration may cause the mesh to tighten, while a measurement of decreased pressure, velocity or acceleration may cause the mesh to loosen. The actuator may tighten or loosen the mesh through mechanical application of force, through electrostatics or otherwise through the application of an electric field, voltage or current, through magnetism, or the like. For example, in one embodiment the mesh may be an electroactive polymer or made from electroactive polymer fibers that are pulled tight when a voltage is applied thereto. As another example, the mesh may be formed from any suitable fibers in a weave and mechanically pulled to tighten the mesh.

Method of Operation

Figure 3:
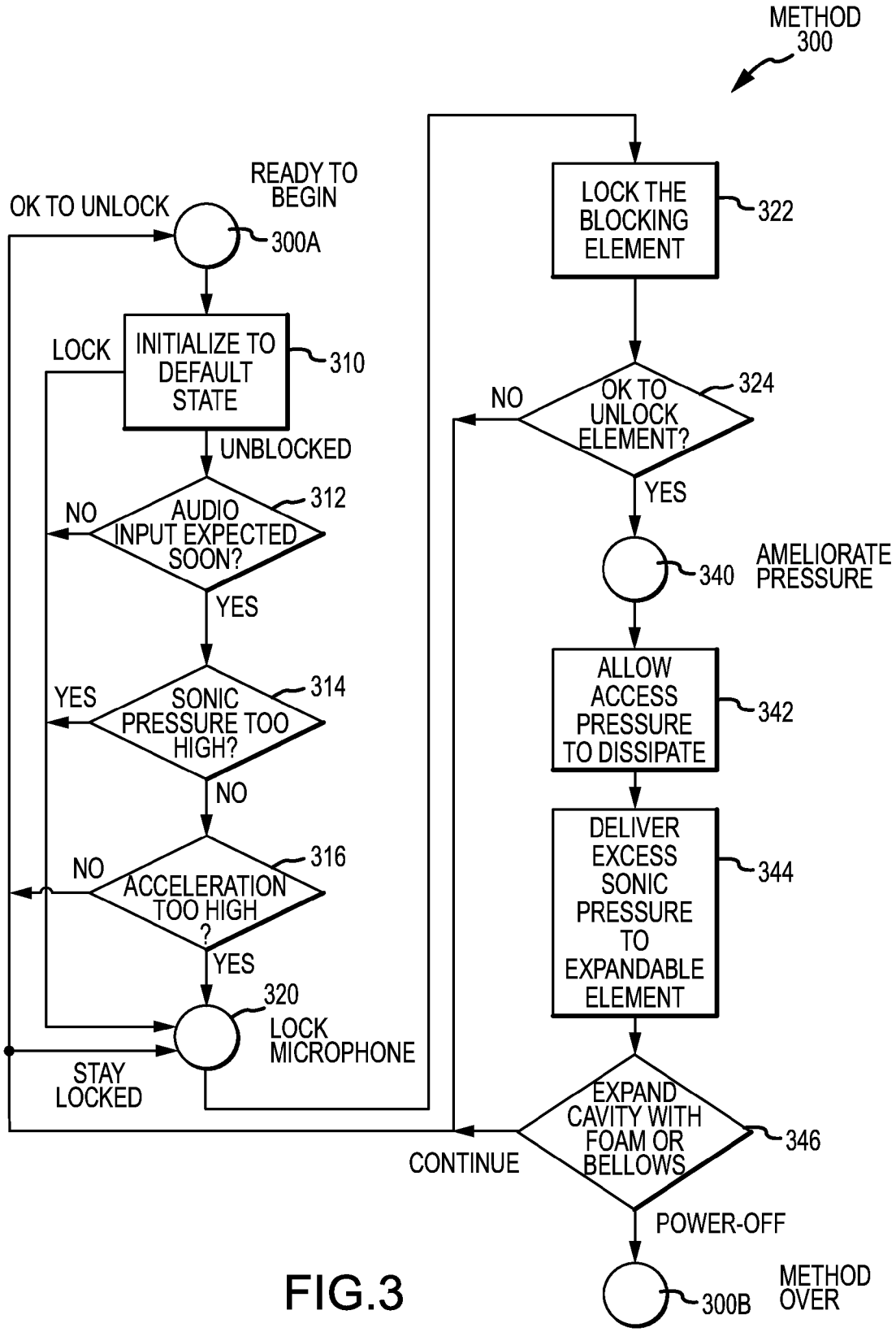
FIG. 3 shows a conceptual drawing of a method of operation.

FIG. 3 shows a conceptual drawing of a method of operation.

A method 300 includes a set of flow points and method steps.

Although these flow points and method steps are shown performed in a particular order, in the context of the invention, there is no particular requirement for any such limitation. For example, the flow points and method steps could be performed in a different order, concurrently, in parallel, or otherwise. Similarly, although these flow points and method steps are shown performed by a general purpose processor in a force sensitive device, in the context of the invention, there is no particular requirement for any such limitation. For example, one or more such method steps could be performed by special purpose processor, by another circuit, or be offloaded to other processors or other circuits in other devices, such as by offloading those functions to nearby devices using wireless technology or by offloading those functions to cloud computing functions.

At a flow point 300A, the method 300 is ready to begin.

At a step 310, the method 300 initializes the blocking element 130 in its default state. In embodiments in which the default state is "unlocked" (that is, allowing passage of sound waves), the method 300 sets the blocking element 130 to unlocked, such as by disposing the blocking element 130 in a position or orientation that allows sound waves to reach the microphone port 132 and the microphone 134 from the ambient atmosphere 124 and the input port 126. In embodiments in which the default state is "locked" (that is, blocking sonic pressure), the method 300 proceeds with the flow point 320.

At a step 312, the method 300 determines if audio input is expected in the near future, such as for the next several dozen milliseconds. If so, the method 300 proceeds with the next step. If not, the method 300 proceeds with the flow point 320.

At an (optional) step 314, the method 300 determines if sonic pressure at the input port 126 exceeds a maximum safe amount. For example, if a normal sound wave can reach a regular pressure amount of about 2 PSI, the maximum safe amount of sonic pressure might be set to be about 5 PSI, or some amount near to that. If not, the method 300 proceeds with the next step. If so, the method 300 proceeds with the flow point 320.

At an (optional) step 316, the method 300 determines if a measure of acceleration of the device exceeds a maximum safe amount. For example, if a normal acceleration can reach a normal acceleration of about 2 g (gravities), the maximum safe amount of acceleration might e set to be about 5 g, or some amount near to that. If not, the method 300, having determined there is no current reason to protect against sonic pressure, returns to the flow point 300A, where it re-begins. If so, the method 300 proceeds with the flow point 320.

While this application describes both the step 314 (in which the method 300 determines if there is excess sonic pressure) and the step 316 (in which the method 300 determines if there is excess acceleration) as optional, at least one of these steps should be performed, if the method 300 is going to protect the microphone against excess sonic pressure. However, if the method 300 is alternatively going to ameliorate excess sonic pressure instead, it is possible that neither such optional step is performed, and the method need not perform either such optional step.

At a flow point 320, the method 300 is ready to protect the microphone against excess sonic pressure.

At an (optional) step 322, the method 300 alters the state of the blocking element 130 to a "locked" state (that is, blocking sonic pressure), For a first example, as further described with respect to the FIG. 2A, the method 300 can cause a flap to close, either in response to the step 314 (when a maximum safe amount of sonic pressure was measured) or in response to the step 316 (when a maximum safe acceleration was measured). In such cases, the method 300 can cause the flap to close automatically, such as due to the excess sonic pressure pushing the flap closed, or such as the excess acceleration causing the flap, or a weight on the flap, to move to close the flap.

For a second example, as further described with respect to the FIG. 2B, the method 300 can cause a bistable, multi-stable, or meta-stable element to close, again, either in response to the step 314 (when a maximum safe amount of sonic pressure was measured) or in response to the step 316 (when a maximum safe acceleration was measured). In such cases, the method 300 can cause the bistable, multi-stable, or meta-stable element to close in response to the step 314 or in response to the step 316, using an actuator, such as described with respect to the FIG. 2B.

For a third example, as further described with respect to the FIG. 2C, the method 300 can cause a rotatable element to move (such as to close a path between the input port 126 and the microphone port 132), either in response to the step 314 or in response to the step 316, using an actuator, such as described with respect to the FIG. 2C.

For a fourth example, as further described with respect to the FIG. 2D, the method 300 can cause a linear element to move (such as to close a path between the input port 126 and the microphone port 132), either in response to the step 314 or in response to the step 316, using an actuator, such as described with respect to the FIG. 2D.

For a fifth example, as further described with respect to the FIG. 2E, the method 300 can cause a mesh to become relatively closed (such as to restrict the flow of sonic pressure and sound waves between the input port 126 and the microphone port 132), either in response of the step 314 or in response to the step 316, using an actuator, such as described with respect to the FIG. 2E.

While this application describes each of the examples (first with respect to FIG. 2A, second with respect to FIG. 2B, third with respect to FIG. 2C, fourth with respect to FIG. 2D, and fifth with respect to FIG. 2E) as separate examples, in the context of the invention, there is no particular requirement for any such limitation. For example, two or more such examples can be performed by the method 300.

While this application describes the step 342, and each of its examples, as optional, at least one of these steps should be performed, if the method 300 is going to protect the microphone against excess sonic pressure. However, if the method 300 is alternatively going to ameliorate excess sonic pressure instead, it is possible that the method need not perform either such optional step.

At a flow point 340, the method 300 is ready to ameliorate excess sonic pressure.

At an (optional) step 342, the method 300 allows excess sonic pressure into the cavity 128, wherein the input port 124 is disposed at an offset location from the microphone port 132. This can have the effect that the excess sonic pressure is allowed to expand and dissipate, with the effect of ameliorating its effect, on the microphone port 132 and the microphone 134.

At an (optional) step 344, the method 300 allows excess sonic pressure into the cavity 128, wherein the input port 124 is disposed near to (such as directly opposite) an expandable element 142. This can have the effect that the expandable element 142 can receive the sonic pressure, and expand in response thereto. The expandable element 142 can expand the cavity 128, ameliorating the effect of the sonic pressure on the microphone port 132 and the microphone 134. Alternatively, the expandable element 142 can receive the brunt of the sonic pressure, ameliorating the effect of the sonic pressure on the microphone port 132 and the microphone 134.

In one embodiment, the expandable element 142 can be allowed to expand sufficiently that it actually breaks, leaving an acoustic pathway between the cavity 128 and other elements of the device. While this is not a generally desirable result, it can be superior to allowing the microphone 134 to break. Should this occur, the microphone 134 might exhibit reduced function, such as due to noise from the acoustic pathway between the cavity 128 and other elements of the device. However, this example of reduced function might be considered superior to breaking the microphone 134 itself, which would cause the microphone 134 to exhibit substantially no function, which is typically inferior to exhibiting reduced function.

At an (optional) step 346, the method 300 allows the cavity 128 to expand, such as by compressing a foam block 144 (or other compressible element) to absorb sonic pressure, or such as by allowing a bellows (not shown) to expand. After reading this application, those skilled in the art will recognize that the expandable element 142 is a form of bellows, but that a more general bellows, such as one that allows the entire cavity 128 to expand under sonic pressure, might also be desirable.

Similarly, as part of the step 346, the method 300 can allow one or more foam blocks 144 (or other compressible elements) to absorb excess sonic pressure on the microphone 134. For example, excess sonic pressure on the microphone 134 can be absorbed by the one or more foam blocks 144 (or other compressible elements), with the effect that excess sonic pressure on the on the microphone 134 can be reduced to the point where damage to the microphone 134 is minimized or perhaps even averted.

While this application describes each of the steps 342 (in which the method 300 allows excess sonic pressure into the cavity 128), the step 344 (in which the method 300 causes an expandable element to operate), and the step 346 (in which the method 300 allows the cavity 128 to expand) as optional, at least one of these steps should be performed, if the method 300 is going to ameliorate the effect of excess sonic pressure. However, if the method 300 is alternatively going to prevent excess sonic pressure from reaching the microphone 134 instead, it is possible that neither such optional step is performed, and the method need not perform either such optional step.

After the step 346, the method 300 determines if it should continue. If so, the method 300 proceeds with the flow point 300A, where the method 300 is ready to re-begin. If not, the method 300 proceeds with the flow point 300B, where the method 300 is done.

At a flow point 300B, the method 300 is over. In one embodiment, the method 300 repeats so long as the force sensitive device is powered on.

We claim:

1. An apparatus, comprising:

a microphone port positioned to admit sound waves to a microphone;

a cavity offset from the microphone port and operative to direct pressure away from the microphone port; and an expandable element associated with the cavity, the expandable element having a first state that reduces an effect of sound pressure on the microphone port and a second state that does not reduce an effect of sound pressure on the microphone port.

2. The apparatus of claim 1, wherein the cavity includes an input port.

3. The apparatus of claim 2, wherein the sound pressure entering the input port is applied to the expandable element before reaching the microphone port, and wherein the sound pressure entering the input port alters a size or shape of the cavity.

4. The apparatus of claim 3, wherein the expandable element is breakable in response to the sound pressure, and wherein the expandable element vents at least a portion of the sound pressure from the cavity.

5. The apparatus of claim 1, wherein the expandable element is responsive to a measure of acceleration.

6. The apparatus of claim 1, wherein the expandable element is responsive to a measure of sound pressure.

7. The apparatus of claim 2, wherein the sound pressure entering the input port is dissipated before reaching the microphone port.

8. The apparatus of claim 1, wherein the expandable element is a foam block.

9. The apparatus of claim 8, wherein the foam block is expandable.

10. The apparatus of claim 8, wherein the foam block is compressible.

11. The apparatus of claim 1, wherein the expandable element is a diaphragm.

12. A method, comprising:

receiving sound waves at a cavity offset from a microphone port that is configured to admit sound waves to a microphone;

setting a blocking element in a first expansion state that prevents sound waves from reaching the microphone port in response to receiving a first indicator; and setting the blocking element in a second expansion state that allows sound waves to reach the microphone port in response to receiving a second indicator.

13. The method of claim 12, wherein the first indicator or the second indicator is a measure of acceleration.

14. The method of claim 12, wherein the first indicator or the second indicator is a measure of sound pressure.

15. The method of claim 12, wherein the blocking element includes one or more mechanical elements capable of being moved into a pathway between an audio input port and the microphone port.

16. A method, comprising:

receiving sound waves at a cavity offset from a microphone port that is configured to admit sound waves to a microphone;

setting an ameliorating element in a first expansion state to direct sound pressure away from the microphone port in response to a first indicator; and setting the ameliorating element in a second expansion state that does not reduce an effect of sound pressure on the microphone port in response to a second indicator.

17. The method of claim 16, further comprising operating the ameliorating element in response to a measure of acceleration.

18. The method of claim 16, further comprising operating the ameliorating element in response to a measure of sound pressure.

19. The method of claim 16, wherein the ameliorating element comprises an expandable element that expands and contracts in response to the sound pressure.

20. The method of claim 16, further comprising determining whether sound pressure is expected prior to setting the ameliorating element in the first state.

* * * * *